US007644810B2

(12) United States Patent
Duncan

(10) Patent No.: US 7,644,810 B2
(45) Date of Patent: Jan. 12, 2010

(54) SPORTS EQUIPMENT BAG WITH INTEGRATED STOOL

(76) Inventor: Cameron Duncan, 300, 1324 17th Ave SW., Calgary, Alberta (CA) T2T 5S8

( * ) Notice: Subject to any disclaimer, the term of this patent is extended or adjusted under 35 U.S.C. 154(b) by 178 days.

(21) Appl. No.: 11/459,720

(22) Filed: Jul. 25, 2006

(65) Prior Publication Data

US 2008/0023282 A1 Jan. 31, 2008

(51) Int. Cl.
*A45C 9/00* (2006.01)
*A45C 5/14* (2006.01)
*A47C 7/50* (2006.01)

(52) U.S. Cl. ..... 190/8; 190/1; 190/18 A; 206/315.1; 297/423.1

(58) Field of Classification Search ..... 206/315.1; 190/1, 8, 18 A; 224/155; 297/118, 217.1, 297/423.14, 423.1, 423.39; 280/37.647
See application file for complete search history.

(56) References Cited

U.S. PATENT DOCUMENTS

| | | | | | |
|---|---|---|---|---|---|
| 1,396,100 | A | | 11/1921 | Davis et al. | |
| 2,097,273 | A | * | 10/1937 | Feist | 482/52 |
| 2,267,158 | A | * | 12/1941 | Locke | 34/90 |
| 2,667,658 | A | | 2/1954 | Cornick | |
| 2,685,317 | A | * | 8/1954 | Lace et. al. | 206/315.6 |
| 3,347,346 | A | * | 10/1967 | Young | 190/110 |
| 3,363,940 | A | * | 1/1968 | Miller | 297/217.1 |
| 3,662,932 | A | | 5/1972 | Kerschner | |
| 4,021,054 | A | | 5/1977 | Csutor | |
| 4,394,042 | A | * | 7/1983 | Smith | 294/163 |
| 5,186,372 | A | | 2/1993 | Biedenharn, Jr. | |
| 5,462,213 | A | | 10/1995 | Watt | |
| 5,899,467 | A | * | 5/1999 | Henkel | 280/47.25 |
| 5,915,551 | A | * | 6/1999 | Vavro | 206/315.5 |
| 5,954,248 | A | | 9/1999 | Jasper | |
| 5,957,349 | A | * | 9/1999 | Krulik | 224/155 |
| 6,042,127 | A | * | 3/2000 | Rupolo | 280/33.998 |
| 6,095,385 | A | | 8/2000 | Utu et al. | |
| 6,193,082 | B1 | * | 2/2001 | Bartle | 211/85.7 |
| 6,264,078 | B1 | | 7/2001 | Bilang | |
| 6,431,333 | B1 | | 8/2002 | Glodich | |
| 6,508,359 | B1 | * | 1/2003 | He et al. | 206/315.3 |
| 6,530,507 | B2 | | 3/2003 | Oh | |
| 2006/0006034 | A1 | * | 1/2006 | Nordstrom | 190/18 A |

FOREIGN PATENT DOCUMENTS

WO WO 2005/023054 3/2005

* cited by examiner

*Primary Examiner*—Sue A Weaver
(74) *Attorney, Agent, or Firm*—Maxey Law Offices, PLLC; Stephen Lewellyn; Brittany Maxey

(57) ABSTRACT

A sports equipment bag with an integrated stool for storing, carrying and transporting sporting equipment while providing a foot support to aide a user in donning their sporting equipment. The foot support can be utilized by a single person alone to aid in putting their own equipment on or the foot support can be used in combination with the integrated stool to assist a first person in aiding a second person in donning equipment. The stool and foot support are integrated into the bag and the foot support is positioned within the bag's internal compartment. Along the bottom portion of the bag are a pair of spaced apart ground engaging wheels rotatably and a telescopic handle may be extendable from the bag, thus making the bag, stool and foot support easily storable and transportable.

17 Claims, 7 Drawing Sheets

SPORTS EQUIPMENT BAG WITH INTEGRATED STOOL

BACKGROUND OF THE INVENTION

1. Field of the Invention

The present invention relates generally to sports equipment carrying bags. More particularly, relating to a sports equipment carrying bag having an integrated footwear donning stool, for use, for example with hockey equipment and aiding in donning of ice skates or roller skates.

2. Description of the Related Art

Sports equipment carrying bags are known in the art for use in carrying the equipment of a myriad of different sports. More specifically, hockey equipment bags heretofore devised and utilized are known to consist of familiar, expected and obvious structural configurations, and do not include a stool for aiding in the donning of footwear, such as skates. Examples of sports equipment bags are described in U.S. Pat. Nos. 6,095,385; 6,431,333.

Carrying bags incorporating seating arrangements are known in the art for use in carrying various articles and providing a seat. Carrying bags incorporating seating arrangements heretofore devised and utilized are known to consist of familiar, expected and obvious structural configurations, and do not include a stool for aiding in the donning of footwear.

Examples of carrying bags having seating arrangements are described in U.S. Pat. Nos. 5,954,248; 3,662,932; 5,186,372; 5,462,213; and 6,264,078.

While the devices heretofore fulfill their respective, particular objectives and requirements, they do not provide a sports equipment carrying bag with an integrated footwear donning stool. As such, there exists a need to for a sports equipment carrying bag with an integrated footwear donning stool, which substantially departs from the prior art, and in doing so provides an apparatus primarily developed for the purpose of carrying sports equipment in an organized manner and aiding in the donning of footwear.

SUMMARY OF THE INVENTION

In view of the foregoing disadvantages inherent in the known types of sports equipment carrying bags and carrying bags including seating arrangements now present in the prior art, the present invention provides a new sports equipment carrying bag with an integrated footwear donning stool construction wherein the same can be used for carrying and storing sports equipment and aiding in the donning of footwear. The intended use of the sports equipment carrying bag with an integrated footwear donning stool is to aid a person in the donning of relatively cumbersome articles of footwear, such as for example, a pair of ice skates. The stool provides a foot support and seat for a first person to aid a second person in putting on equipment, such as pads and skates. For example, a parent could sit on the stool to aid a child in putting on their equipment. Additionally, the stool can be utilized by a single person alone to aid in putting their equipment on. The stool being integrated with the bag portion is easily transported along with the bag from one location to another.

In general, in one aspect, a sports equipment carrying bag with an integrated footwear donning stool is provided. The sports equipment carrying bag with an integrated footwear donning stool comprises a bag body including top, bottom, front, back, and a pair of side panels defining an internal compartment. A stool including top, bottom, front, back, and a pair of side walls. The front wall having a slanted wall portion which slants in a direction from front to back of the stool. The stool being positioned within the internal compartment with the top wall juxtaposed the top panel, the bottom wall juxtaposed the bottom panel, and the pair of side walls extending between the top and bottom panels. The bag body can be placed on a ground surface with the bottom panel adjacent the ground surface providing a seating surface defined by the top wall and a foot supporting surface defined by the slanted wall portion to aid in the donning of an article of footwear.

In general, in another aspect, the sports equipment carrying bag with an integrated footwear donning stool can further include a seat member attached to the top wall sandwiching the top panel therebetween.

In general, in another aspect, the sports equipment carrying bag with an integrated footwear donning stool can further include a pair of spaced apart ground engaging wheels rotatably attached to the bottom panel approximate the back panel.

In general, in another aspect, the sports equipment carrying bag with an integrated footwear donning stool can further include a handle engaged on a telescopic tube assembly which is upwardly extendable and retractable from the bag body above the pair of wheels when the bag body is positioned upright.

In general, in another aspect, the a sports equipment carrying bag with an integrated footwear donning stool can further include a pair of spaced apart ground engaging members attached the bottom panel approximate the bottom wall and extending outwardly therefrom between the pair of side panels, whereby each ground engaging member is engagable with the ground surface when the bag body is placed on the ground surface with the bottom wall adjacent the ground surface to prevent the bag body from slipping when a person sits on the stool or a foot is placed onto the slanted wall portion.

In general, in another aspect, the a sports equipment carrying bag with an integrated footwear donning stool can further include a lip extending from the front wall along a lower edge of the slanted wall portion.

In general, in another aspect, a sports equipment carrying bag with an integrated footwear donning stool is provided. The sports equipment carrying bag with an integrated footwear donning stool includes a bag body including top, bottom, front, back, and a pair of side panels defining an internal compartment. A stool including a top wall, a bottom wall, a front wall, a back wall, a slanted wall extending from an upper edge of the bottom wall to a forward edge of the top wall, and a pair of side walls. The stool being positioned within the internal compartment with the top wall juxtaposed the top panel, the bottom wall juxtaposed the bottom panel, and the pair of side walls extending between the top and bottom panels. The top panel including an opening therethrough permitting unrestricted access to the internal compartment and at least the slanted wall portion of the stool. A flap attached to the top panel and being releasably engagable therewith to close the opening formed through the top panel. The bag body can be placed on a ground surface with the bottom panel adjacent the ground surface providing a seating surface defined by the top wall and a foot supporting surface defined by the slanted wall such that a persons foot can be inserted through the opening and placed upon the slanted wall to aid in the donning of an article of footwear.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
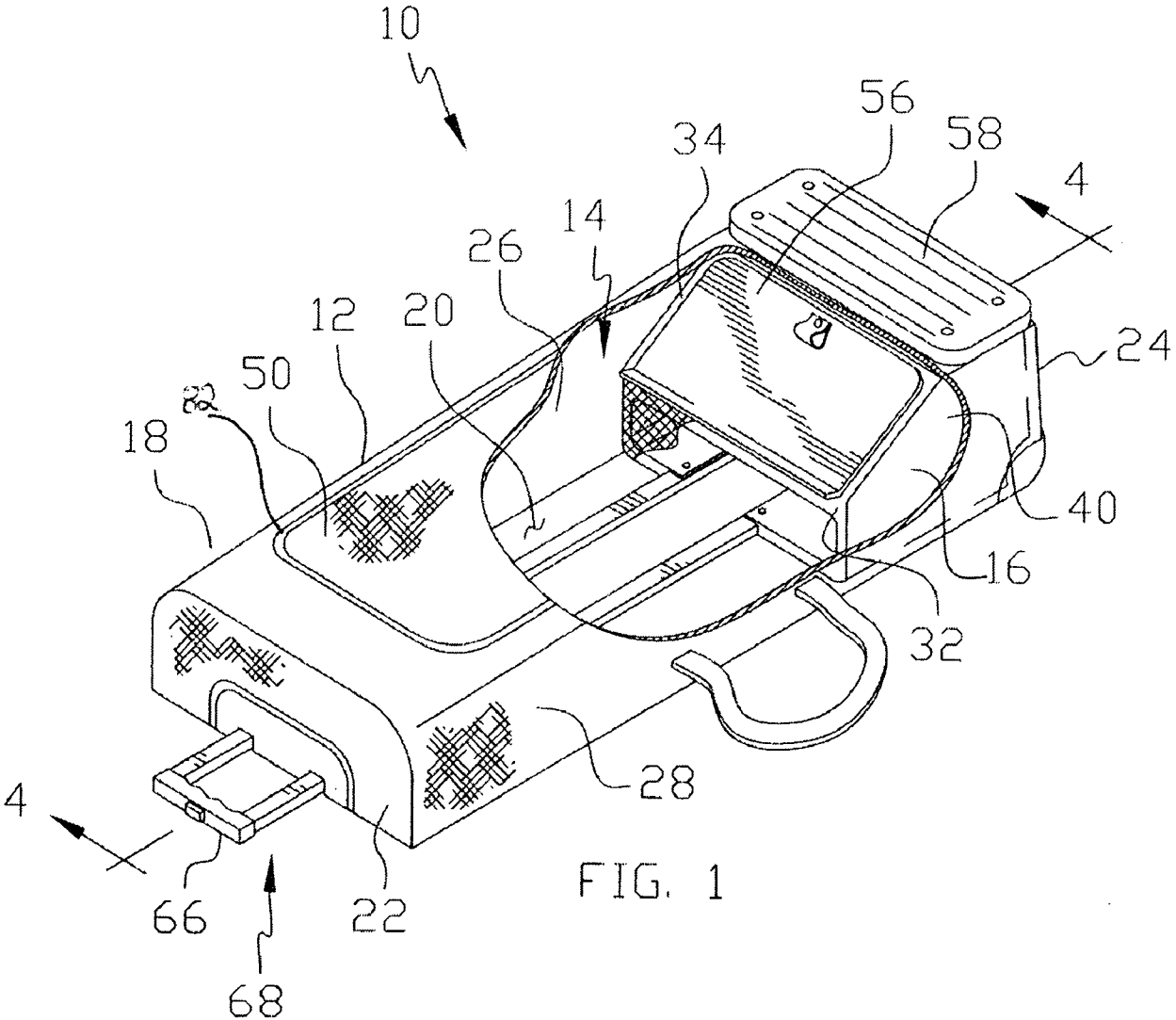
FIG. 1 is a perspective diagrammatic view of the a sports equipment carrying bag with an integrated footwear donning stool constructed in accordance with the principles of the present invention.

Referring now to FIGS. 1-7 of the drawings, reference numeral 10 generally designates the a sports equipment carrying bag with an integrated footwear donning stool of the present invention. The bag body 12 includes at least one internal compartment 14 into which the footwear donning stool 16 is positioned. The internal compartment 14 includes a top panel 18, a bottom panel 20, a front panel 22, a back panel 24 and a pair of side panels 26 and 28 all joined together along common edges to define the internal compartment 14. While the bag body 12 is illustrated only having a single compartment, the overall construction of the bag body can take on various forms to include for example multiple internal compartments, external pockets, carrying straps and handles, etc.

A pair of spaced apart ground engaging wheels 62 are rotatably attached to the bottom panel 20 approximate the back panel 24 of the bag body 12. The pair of wheels 62 provide rolling support to the bag body 12 during transport.

A handle 66 including a telescopic tube assembly 68 which is upwardly extendable and retractable from the bag body 12 above said pair of wheels 62 when the bag body is positioned upright. The telescopic tube assembly 68 includes a pair spaced apart tubes 69 that are attached to the bag body 12 along the bottom panel 20 from the front panel 22 towards the back panel 24. The handle 66 and telescopic tube 68 assembly is of the type commonly used in personal wheeled luggage systems widely used today. Further, it is contemplated, that various forms and constructs of telescopic or retractable handle assemblies could be substituted without departing from the scope of the invention.

The stool 16 includes a top wall 30, a front wall 32 having a inwardly slanted portion 34 which extends from an upper edge 36 of the front wall to a forward edge 38 of the top wall, a pair of sidewalls 40,42, a back wall 44 and a bottom wall 46. The slanted wall portion 34 provided for a foot support. The sidewalls 40, 42 extend from the top wall 30 to the bottom wall 46 and span from the front wall 32 to the back wall 44. A forward edge of each sidewall 40, 42 is shaped to conform to the slanted wall portion 34 of the front wall 32. The back wall 44 extends from the top wall 30 and spans between the pair of sidewalls 40, 42. To reduce manufacture cost, weight and increase storage capacity, the stool 16 can be hollow.

Extending from the slanted wall portion 34 of the front wall 32 along the upper edge 36 is a support lip 52 which acts to engage and support the foot from sliding downward and off of the slanted wall portion. The supporting feature of the lip 52 is important when a person is wearing heavy footwear such as an ice skate to prevent strain to the person in trying to support the footwear on the slanted wall portion 34.

In another aspect, an opening 54 can be formed through the slanted wall portion 34 to permit access within the stool 16, as best seen in FIG. 1. In this aspect, a door 56 is provided to cover the opening 54. The door 56 is hinged to the front wall 32 along the upper edge 36 so that the door opens from approximate the top wall 30 and swings downwardly towards the bottom wall 46. In this arrangement, the lip 52 is formed along the lower edge of the door 56. Additionally, a second opening 60 is formed through the front wall 32 below the slanted wall portion 34 to allow elongated articles, such as a hockey stick to be placed in the internal compartment 14 and extend into the stool 16. Netting 76 can cover the opening 60 and one or more slots 78 can be formed through the netting, as shown best in FIG. 7. The slots 78 permits the insertion of an elongated article through the netting 76 and into the hollow portion of the stool 16 while preventing smaller items from entering into the hollow portion of the stool.

Figure 4:
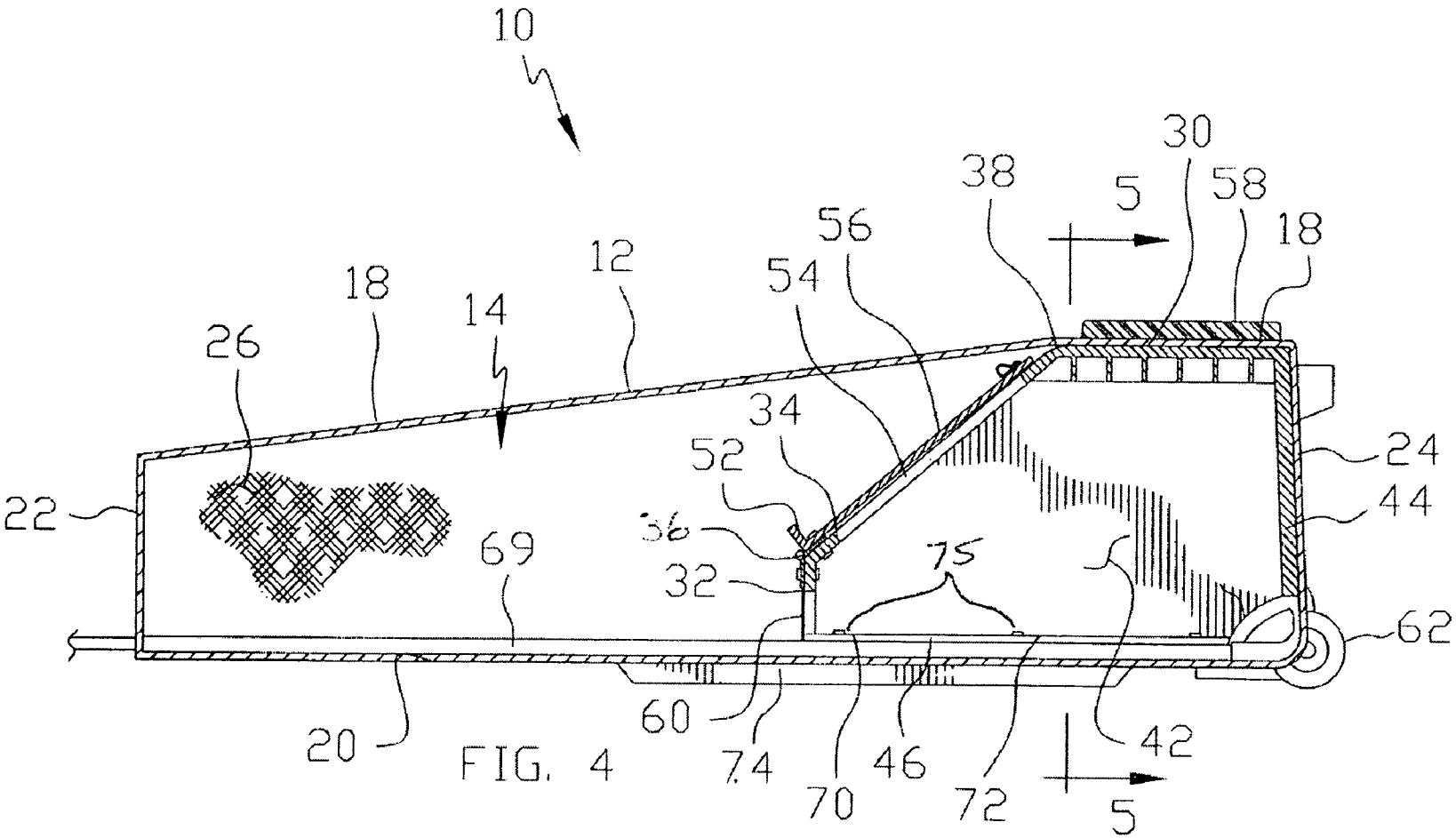
FIG. 4 is a diagrammatic cross section view taken along line 4-4 in FIG. 1, illustrating construction features of the stool and the sports equipment bag.
Figure 5:
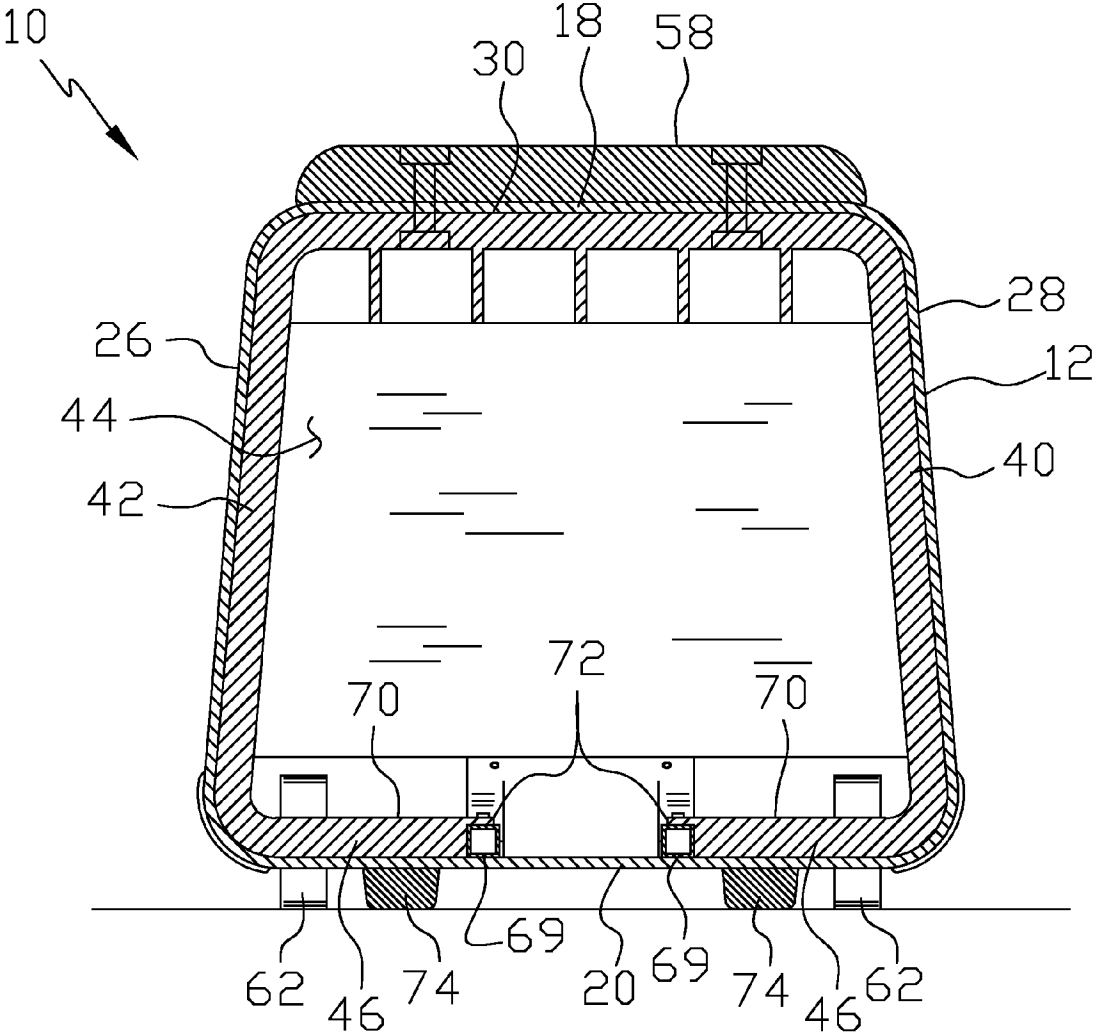
FIG. 5 is a diagrammatic cross section view take along line 5-5 in FIG. 4, illustrating construction features of the stool and the sports equipment bag.

With particular reference to FIGS. 4 and 5, the stool 16 is positioned within the internal compartment 14 with the top wall 30, bottom wall 46, back wall 44, and sidewalls 40, 42 juxtaposed the top panel 18, bottom panel 20, back panel 24, and side panels 26, 28 respectively. The sidewalls 40, 42 extend between the top and bottom panels 18, 20. The stool 16 fills out at least a portion of the internal compartment 14 which it occupies along at least the top panel 18, bottom panel 20, back panel 24 and side panels 26, 28 and provides support to the respective panels.

A seat member 58 is attached to the top wall 30 of the stool sandwiching the top panel 18 about the top wall and between the seat member and the top wall. The seat member 48 is of a length and width to correspond to the length and width of the top wall 30.

Figure 2:
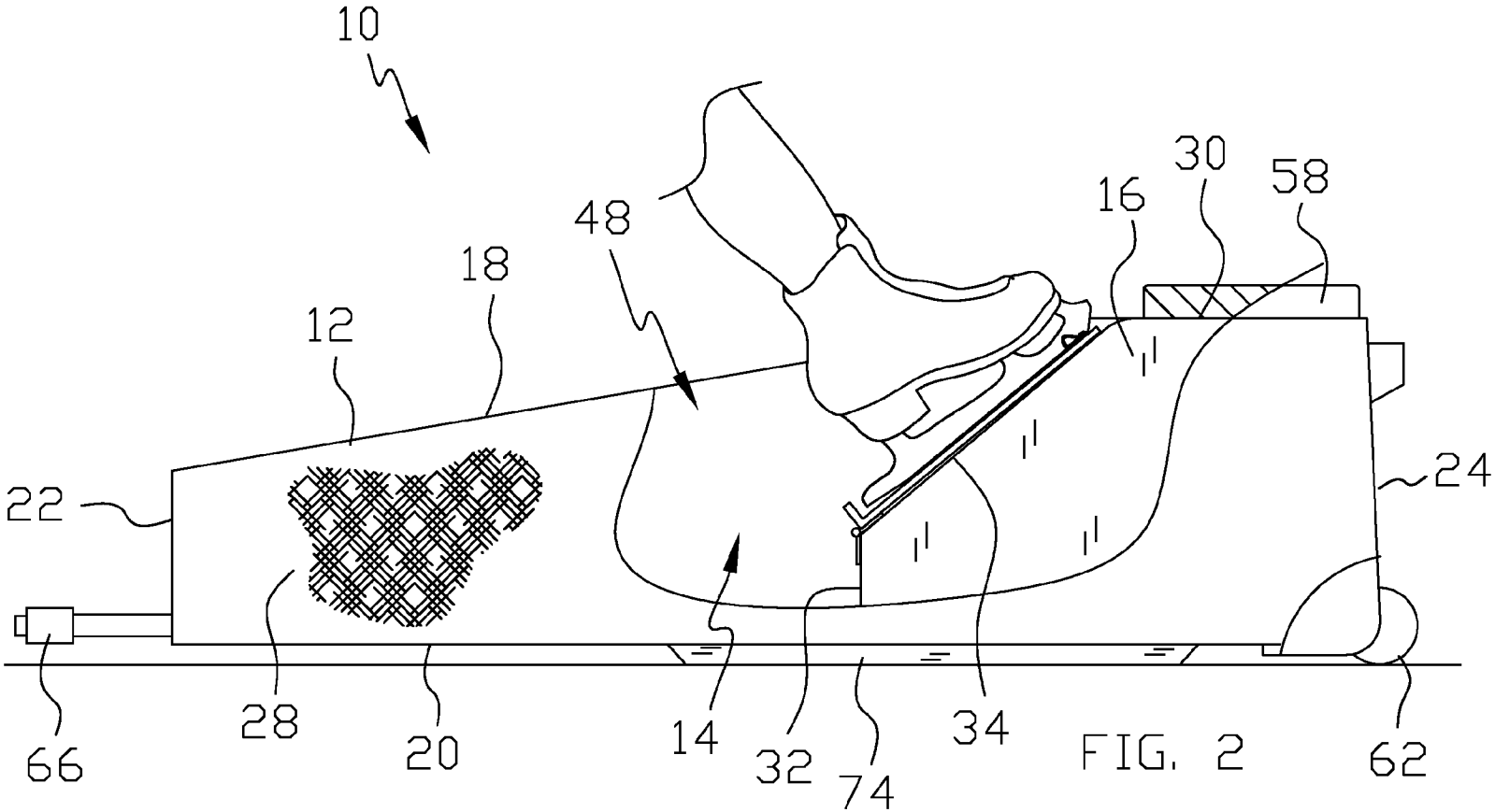
FIG. 2 is a side elevation diagrammatic view showing a partial cross section thereof with a foot bearing an ice skate inserted into the internal compartment and resting upon the slanted wall portion of the stool.
Figure 3:
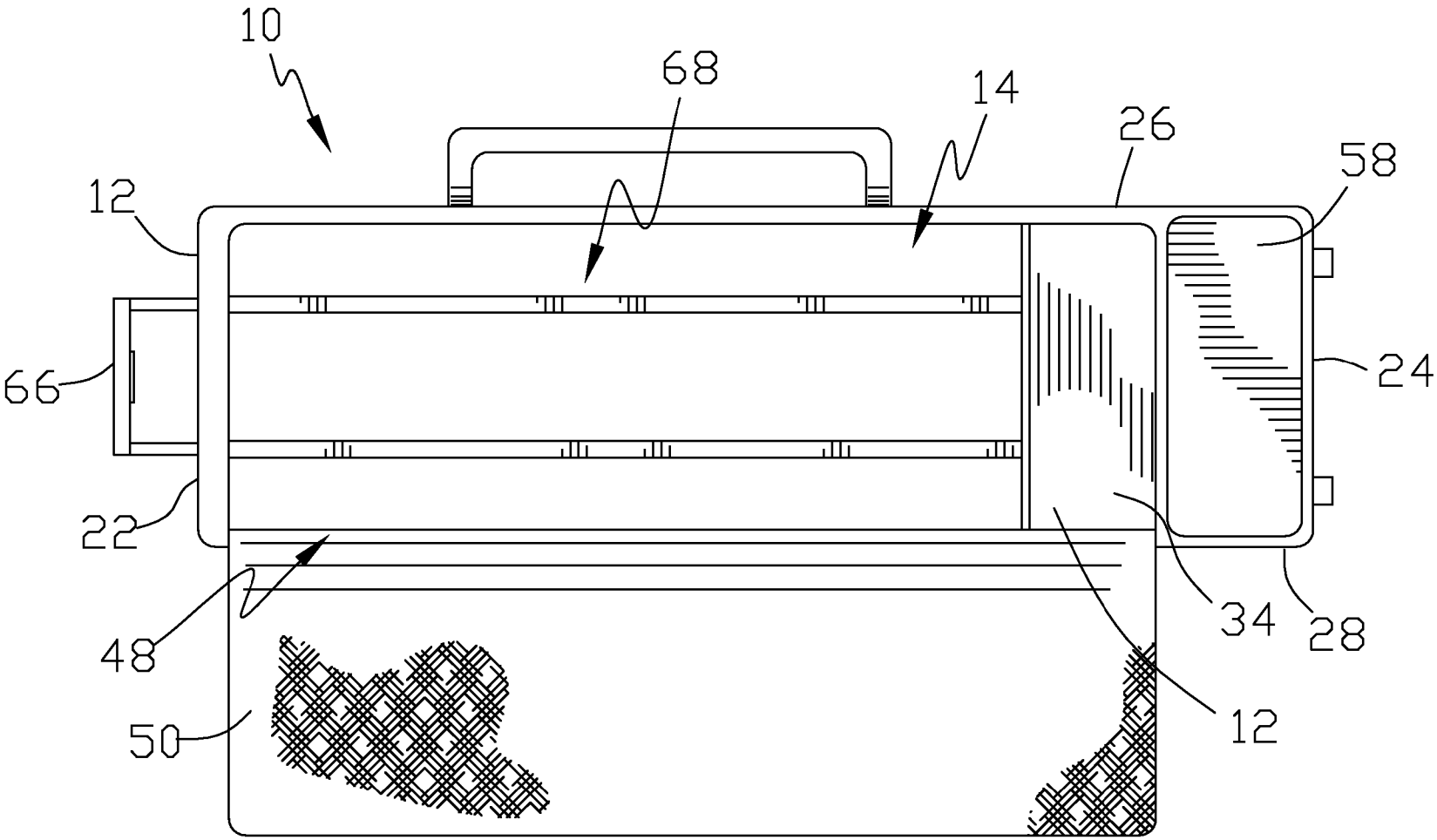
FIG. 3 is a top plan diagrammatic view showing the opening in the top panel of the bag open allow access to the internal compartment and the slanted wall portion of the stool.

With reference now to FIGS. 1, 2, and 3, an opening 48 is formed through the top panel 18 permitting access to the internal compartment 14 and at least the slanted wall portion 34 of the stool 16. The opening 48 is sized to permit the insertion of a person's foot including footwear into the internal compartment 14 to be placed and supported upon the slanted wall portion 34. The opening 48 includes a perimeter that extends generally along the forward edge 38 of the top wall 30 of the stool 16, adjacent the side panels 26, 28 towards the front panel 22, and along the front panel 22 defining a generally rectangular opening. While opening 48 is illustrated as being generally rectangular, the opening can take on various forms and configuration so long as the internal compartment 14 at least the slanted wall portion 34 can be accessed. It is contemplated a bag body 12 can be formed which completely encloses and conforms to the surface of stool 16, in which case there may not be a need for an opening to permit access into the area of the bag body which holds the stool. A closure flap 50 for covering the opening 48 is attached to the top panel 18 along one edge of the perimeter of the opening 48. Using mating fasteners 82, such as a zipper or a pile fastener, the remaining edges of the flap 50 are detachably secured to the top panel 18 to cover the opening 48.

To accommodate space taken within the internal compartment 14 by the wheels 62 along the joining edge of the bottom panel 20 with the back panel 24, the lower rearward corner 64 of each sidewall 40, 42 can be cutout forming a quarter circle. The bottom wall 46 extends from the front wall 32 to the forward quadrant edge of the quarter circle cutout of each sidewall 40, 42. The back wall 44 extends from the top wall 30 to the upper quadrant edge of the quarter circle cutout of each sidewall 40, 42.

The bottom wall 46 of the stool 16 is formed by a pair of inwardly extending tabs 70 which extend from the lower edges of each sidewall 40, 42 and terminate opposed facing ends 72. Each end 72 includes an elongated channel which engages a respective tube 69 of the telescopic tube assembly 68 attached to the bottom panel 20. Fasteners 75 attach each tab along its respective tube. It is important to note, the bottom wall 46 can take on other various other forms of construction and should not be limited to this particular construction. For example, the bottom wall 46 can be a continuous wall which is directly attachable to the bottom panel 20 or can be a continuous wall having one or more recesses or groves formed along the length thereof to receive the spaced apart tubes 69 of the telescopic tube assembly 68.

A pair of spaced apart ground engaging members 74 are attached to the bottom panel 20 approximate the bottom wall 46 and extending outwardly therefrom between the pair of side panels 26, 28, as best shown in FIG. 5. The ground engaging members 74 are frictionally engagable with the ground surface when the bag body 12 is placed on the ground surface with the bottom wall adjacent the ground surface to prevent the bag body from slipping when a person sits on the stool 16 or a foot is placed onto the slanted wall portion 34

Figure 6:
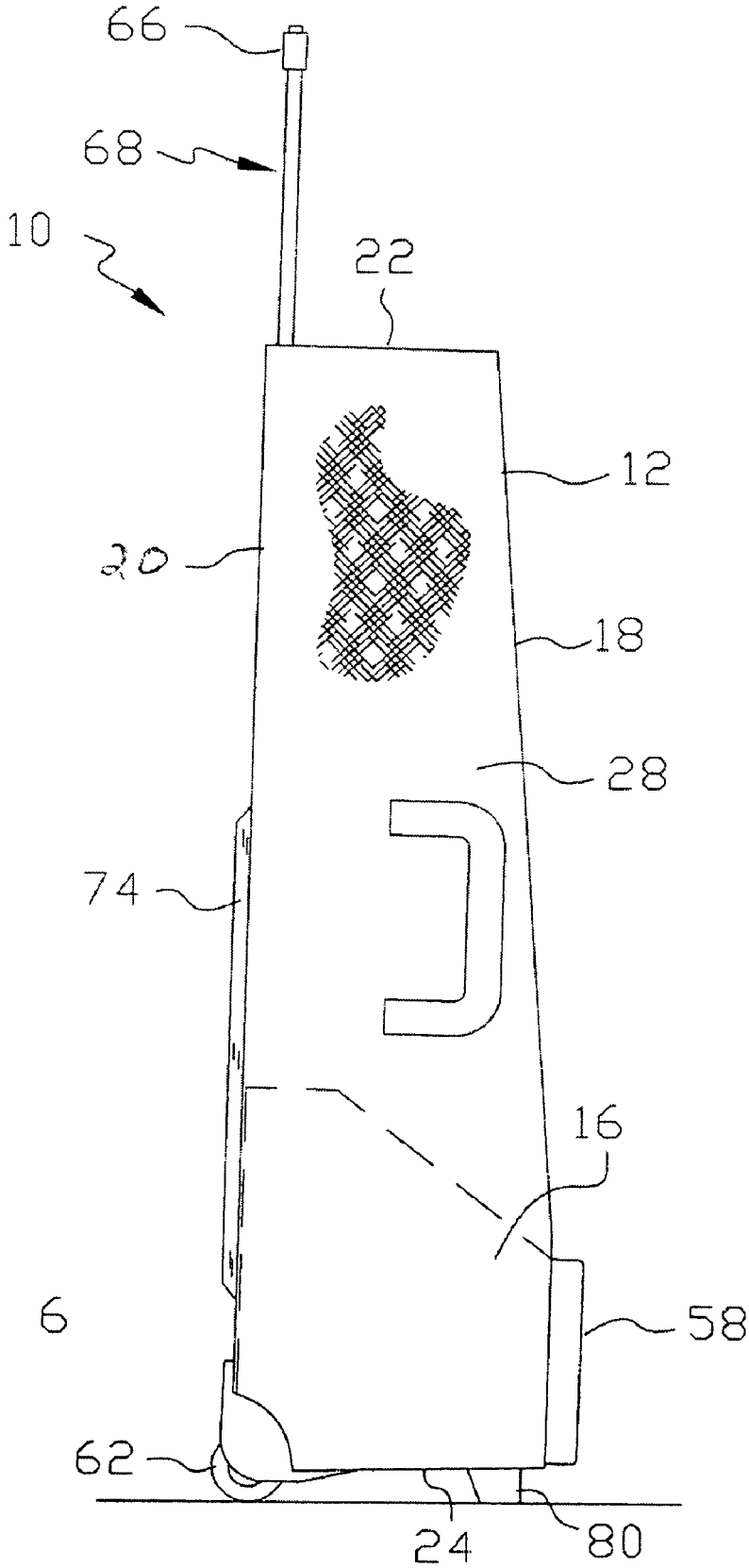
FIG. 6 is a side elevation diagrammatic view showing the sports equipment bag placed upright on end with the handle extended outward from the bag.
Figure 7:
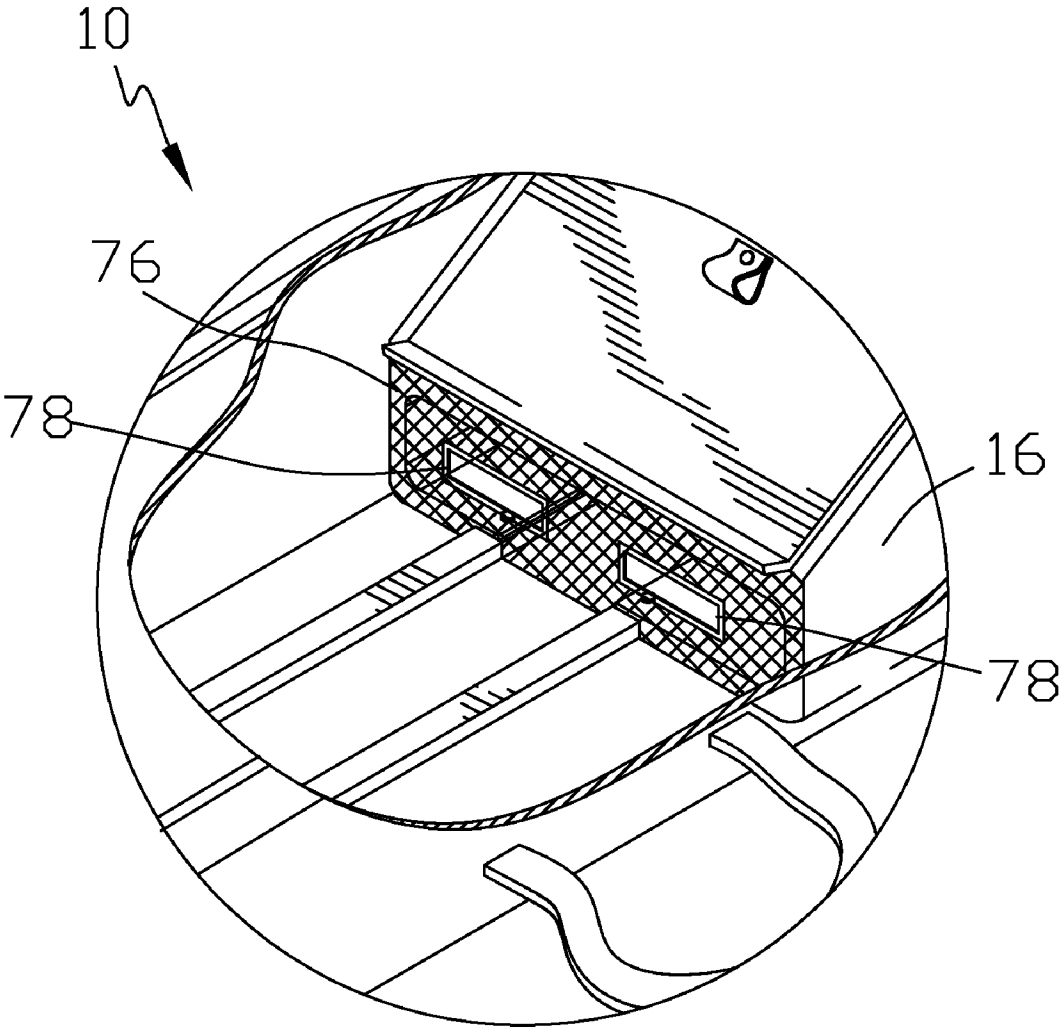
FIG. 7 is an enlarged detail view of a the sports equipment bag of FIG. 1.

With particular reference to FIG. 6, the back panel 24 can inwardly slant from the bottom panel 20 to the top panel 18. The slant of the back panel 24 urges the bag 10 forward onto stops 80 when positioned upright to prevent the bag from falling backwards.

It use, it can now be understood, the internal compartment 14 can be used to store and transport various articles of sporting equipment from one location to another. When a person, such as a child, desires to put on an article of footwear such as an ice skate, the bag body 12 is placed upon the ground with the bottom panel 20 adjacent the ground. The opening 48 through the top panel 18 is opened permitting access to the internal compartment 14 and at least the slanted wall portion 34 of the stool. A person can insert a foot along with an article of footwear into the internal compartment 14 for supporting on the slanted wall portion 34. The lip 52 helps to prevent the foot for slipping off of the slanted wall portion 34. A second person can sit on the seat member 58 facing the person and aid the first person in donning the article of footwear and other equipment.

A number of embodiments of the present invention have been described. Nevertheless, it will be understood that various modifications may be made without departing from the spirit and scope of the invention. Accordingly, other embodiments are within the scope of the following claims.

I claim:

1. A sports equipment carrying bag with an integrated footwear donning stool, comprising:

a bag body including top, bottom, front, back, and a pair of side panels defining an internal compartment;

a stool including a top wall, a bottom wall, a front wall, a back wall, a slanted wall portion extending from an upper edge of said front wall to a forward edge of said top wall, and a pair of side walls;

said stool being positioned within said internal compartment with said top wall juxtaposed said top panel, said bottom wall juxtaposed said bottom panel, and said pair of side walls extending between said top and bottom panels;

a seat member attached to said top wall sandwiching said top panel therebetween; and wherein said stool is attached to said bag body, whereby said bag body can be placed on a ground surface with said bottom panel and bottom wall adjacent the ground surface and providing a seating surface defined by said seat member and a foot supporting surface defined by said slanted wall portion to aid in the donning of an article of footwear.

2. The sports equipment carrying bag with an integrated footwear donning stool of claim 1, wherein said top panel includes an opening permitting unrestricted access to said internal compartment and at least said slanted wall portion of said stool, such that a persons foot can be inserted through said opening and placed upon said slanted wall portion.

3. The sports equipment carrying bag with an integrated footwear donning stool of claim 2, further comprising:

a flap attached to said top panel and being releasably engagable therewith to close said opening formed through said top panel.

4. The sports equipment carrying bag with an integrated footwear donning stool of claim 1, further comprising:

a pair of spaced apart ground engaging members attached said bottom panel approximate said bottom wall and extending outwardly therefrom between said pair of side panels, whereby each ground engaging member is engagable with the ground surface when said bag body is placed on the ground surface with said bottom wall adjacent the ground surface to prevent the bag body from slipping when a person sits on the stool or a foot is placed onto said slanted wall portion.

5. The sports equipment carrying bag with an integrated footwear donning stool of claim 1, further comprising:

a pair of spaced apart ground engaging wheels rotatably attached to said bottom panel approximate said back panel.

6. The sports equipment carrying bag with an integrated footwear donning stool of claim 5, further comprising:

a handle engaged on a telescopic tube assembly which is upwardly extendable and retractable from the bag body above said pair of wheels when the bag body is positioned upright.

7. The sports equipment carrying bag with an integrated footwear donning stool of claim 1, wherein said stool is hollow and an opening is formed through said slanted wall portion; and a door is hingidly attached to said stool and covers said opening formed through said slanted wall portion.

8. The sports equipment carrying bag with an integrated footwear donning stool of claim 1, wherein said front wall includes a lip extending therefrom along a lower edge of said slanted wall portion.

9. A sports equipment carrying bag with an integrated footwear donning stool, comprising:

a bag body including top, bottom, front, back, and a pair of side panels defining an internal compartment;

a stool including a top wall, a bottom wall, a front wall, a back wall, a slanted wall portion extending from an upper edge of said front wall to a forward edge of said top wall, and a pair of side walls;

said stool being positioned within said internal compartment with said top wall juxtaposed said top panel, said bottom wall juxtaposed said bottom panel, and said pair of side walls extending between said top and bottom panels;

said top panel including an opening therethrough permitting unrestricted access to said internal compartment and at least said slanted wall portion of said stool; and a flap attached to said top panel and being releasably engagable therewith to close said opening formed through said top panel, whereby said bag body can be placed on a ground surface with said bottom panel adjacent the ground surface providing a seating surface defined by said top wall and a foot supporting surface defined by said slanted wall portion such that a persons foot can be inserted through said opening and placed upon said slanted wall to aid in the donning of an article of footwear.

10. The sports equipment carrying bag with an integrated footwear donning stool of claim 9, wherein said slanted wall portion includes a lip extending outwardly therefrom along at least a partial length thereof approximate the junction between said slanted wall and said front wall.

11. The sports equipment carrying bag with an integrated footwear donning stool of claim 9, further comprising:

a pair of spaced apart ground engaging wheels rotatably attached to said bottom panel approximate said back panel.

12. The sports equipment carrying bag with an integrated footwear donning stool of claim 11, further comprising:

a handle engaged on a telescopic tube assembly which is upwardly extendable and retractable from the bag body above said pair of wheels when the bag body is positioned upright.

13. The sports equipment carrying bag with an integrated footwear donning stool of claim 9, further comprising:

a pair of spaced apart ground engaging members attached said bottom panel approximate said bottom wall and extending outwardly therefrom between said pair of side panels, whereby each ground engaging member is engagable with the ground surface when said bag body is placed on the ground surface with said bottom wall adjacent the ground surface to prevent the bag body from slipping when a person sits on the stool or a foot is placed onto said slanted wall portion.

14. The sports equipment carrying bag with an integrated footwear donning stool of claim 9, wherein said stool is hollow and an opening is formed through said slanted wall portion;

a door is hingidly attached along a lower edge thereof to said front wall, said door covering said opening formed through said slanted wall; and said door includes a lip extending outwardly therefrom along at least a partial length approximate a bottom edge thereof.

15. A sports equipment carrying bag with an integrated footwear donning stool, comprising:

a bag body including top, bottom, front, back, and a pair of side panels defining an internal compartment;

a stool including a top wall, a bottom wall, a front wall, a back wall, a slanted wall portion extending from an upper edge of said front wall to a forward edge of said top wall, and a pair of side walls;

said stool being positioned within said internal compartment with said top wall juxtaposed said top panel, said bottom wall juxtaposed said bottom panel, and said pair of side walls extending between said top and bottom panels;

said top panel including an opening therethrough permitting unrestricted access to said internal compartment and at least said slanted wall portion of said stool;

a flap attached to said top panel and being releasably engagable therewith to close said opening formed through said top panel;

a seat member attached to said top wall sandwiching said top panel therebetween;

a pair of spaced apart ground engaging wheels rotatably attached to said bottom panel approximate said back panel; and a handle engaged on a telescopic tube assembly which is upwardly extendable and retractable from the bag body above said pair of wheels when the bag body is positioned upright, whereby said bag body can be placed on a ground surface with said bottom panel adjacent the ground surface providing a seating surface defined by said top wall and a foot supporting surface defined by said slanted wall portion such that a persons foot can be inserted through said opening and placed upon said slanted wall to aid in the donning of an article of footwear.

16. The sports equipment carrying bag with an integrated footwear donning stool of claim 15, further comprising:

a pair of spaced apart ground engaging members attached said bottom panel approximate said bottom wall and extending outwardly therefrom between said pair of side panels, whereby each ground engaging member is engagable with the ground surface when said bag body is placed on the ground surface with said bottom wall adjacent the ground surface to prevent the bag body from slipping when a person sits on the stool or a foot is placed onto said slanted wall portion.

17. The sports equipment carrying bag with an integrated footwear donning stool of claim 15, wherein said stool is hollow and an opening is formed through said slanted wall portion;

a door is hingidly attached along a lower edge thereof to said front wall, said door covering said opening formed through said slanted wall portion; and said door includes a lip extending outwardly therefrom along at least a partial length approximate a bottom edge thereof.

* * * * *